US005791612A

United States Patent [19]

King

[11] Patent Number: 5,791,612

[45] Date of Patent: Aug. 11, 1998

[54] ADJUSTABLE FURNITURE LEG

[76] Inventor: David Russell King, 61-67 Parramatta Road, Annandale, New South Wales 2038, Australia

[21] Appl. No.: 649,617

[22] PCT Filed: Oct. 31, 1994

[86] PCT No.: PCT/AU94/00670

§ 371 Date: Jul. 26, 1996

§ 102(e) Date: Jul. 26, 1996

[87] PCT Pub. No.: WO95/12337

PCT Pub. Date: May 11, 1995

[30] Foreign Application Priority Data

Nov. 2, 1993 [AU] Australia ..... PM 2169

[51] Int. Cl.[6] ..... F16M 11/24

[52] U.S. Cl. ..... 248/188.4; 248/188.2

[58] Field of Search ..... 248/188.4, 188.3, 248/501, 188.2, 188.1; 108/144

[56] References Cited

U.S. PATENT DOCUMENTS

| | | | |
|---|---|---|---|
| 843,973 | 2/1907 | Taussig | 248/188.4 |
| 1,898,465 | 2/1933 | Peters . | |
| 2,783,583 | 3/1957 | Holmquist | 45/139 |
| 2,956,368 | 10/1960 | Klein | 45/137 |
| 3,045,389 | 7/1962 | Arnit | 45/139 |
| 3,641,620 | 2/1972 | Hage | 16/19 |
| 3,669,393 | 6/1972 | Paine et al. | 248/188.4 |

FOREIGN PATENT DOCUMENTS

| | | | |
|---|---|---|---|
| 2462209 | 5/1976 | Germany | 248/188.4 |
| 659442 | of 1964 | Italy | 248/188.4 |
| 15561 | 10/1897 | Switzerland | 248/188.4 |

*Primary Examiner*—Leslie A. Braun
*Assistant Examiner*—Willie Berry, Jr.
*Attorney, Agent, or Firm*—Michael J. Striker

[57] ABSTRACT

An adjustable furniture leg consisting of a central bolt (1) serving to attach the tubular leg portion to an article of furniture the head of the bolt (2) projecting downwardly, a tubular leg portion (4) surrounding and projecting below the head of the bolt, the upper end of the tubular leg portion being secured to a nut (3) or the like threaded onto the bolt and the lower end of the tubular leg portion being closed by a removable tube closer (5), a cover (6) surrounding the bolt (1) and a portion of the tubular leg portion (4), the cover (6) being secured to the bolt at a predetermined position in relation to the head of the bolt, the arrangement being such that the effective length of the tubular leg (4) portion can be adjusted by screwing the tubular leg portion in or out of the cover (6).

2 Claims, 3 Drawing Sheets

ADJUSTABLE FURNITURE LEG

The present invention relates to an adjustable furniture leg adapted for attachment to the underside of an article of furniture, the extent to which the leg projects downwardly from the article of furniture being readily adjustable. A particular application of the invention is to the two front legs of a chair so that the degree of tilt of the chair can be readily adjusted by manually screwing in or out the lower portion of the leg.

An adjustable furniture leg according to the invention consists in a central bolt serving to attach the leg to an article of furniture the head of the bolt projecting downwardly, a tubular leg portion surrounding and projecting below the head of the bolt, the upper end of the tubular leg portion being secured to means threaded onto the bolt and the lower and of the tubular leg portion being closed by a removable tube closer, a cover surrounding the bolt and a portion of the tubular leg, means securing the cover to the bolt at a predetermined position in relation to the head of the bolt the arrangement being such that the effective length of the leg can be adjusted by screwing the tubular leg portion in or out of the cover.

In order that the nature of the invention may be better understood preferred embodiments thereof are illustrated, by way of example, with reference to the accompanying drawings in which.

Figure 1:
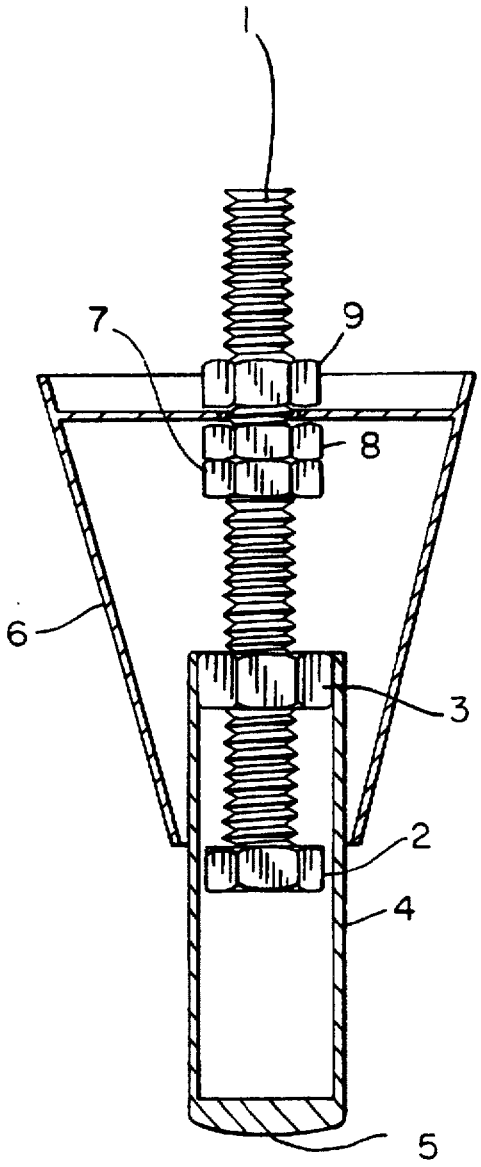
FIG. 1 is a cross-sectional view of a furniture leg according to the invention.
Figure 2:
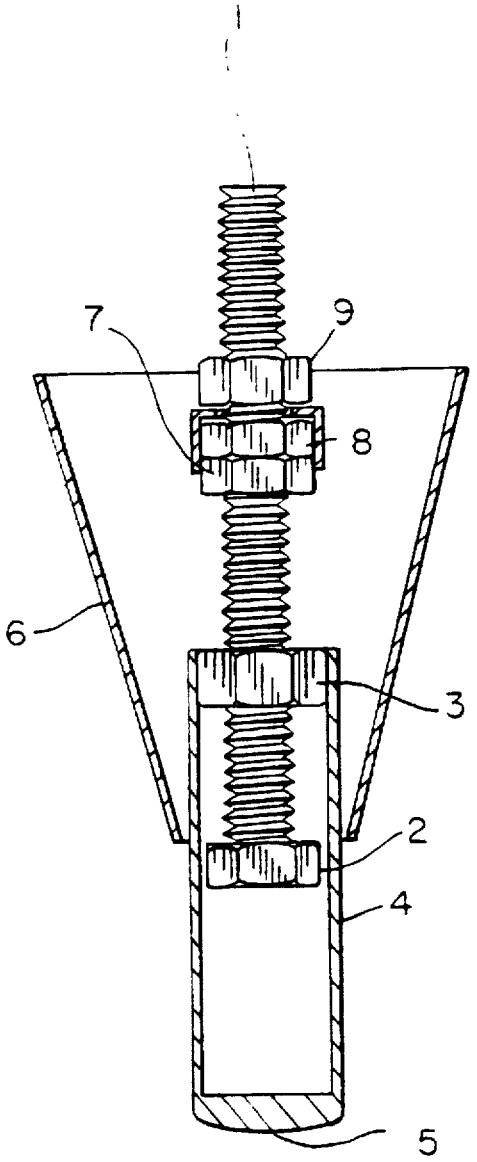
FIG. 2 is a cross-sectional view of the furniture leg of FIG. 1 in a plane at right angles to the plane of FIG. 1.

FIGS. 1 and 2 of the drawings show an adjustable furniture leg of which central bolt 1 provides a means for the attachment of the leg to an article of furniture by being screwed into a fitting (not shown) on the underside of the article of furniture. The head 2 of the bolt is at its lower end and threaded onto the bolt is a nut 3 to which is welded a tubular leg portion 4 which is preferably of steel and the lower end of which is closed by a suitable removable closure 5 preferably of plastic material. It will be evident from the drawing that the tubular lea portion 4 can be rotated and screwed up or down the bolt 1.

That part of the bolt 1 extending below the article of furniture is concealed by a conical cover 6 which is so supported on the bolt 1 by a pair of nuts 7. These nuts are locked together at a suitable position on the bolt and lie within the sides of a channel section member 8 that extends across the interior of the cover 6 the walls of the channel fitting closely about the nut 7. This arrangements prevents rotation of the cover 6 in relation to the bolt. The cover 6 is held against axial movement in relation to the bolt 1 by the nut 9.

The arrangement provides very simply adjustment of the length of the leg and by providing suitable finishes to the exterior of the cover S and the tubular leg portion 4 can be given a very attractive appearance.

Figure 3:
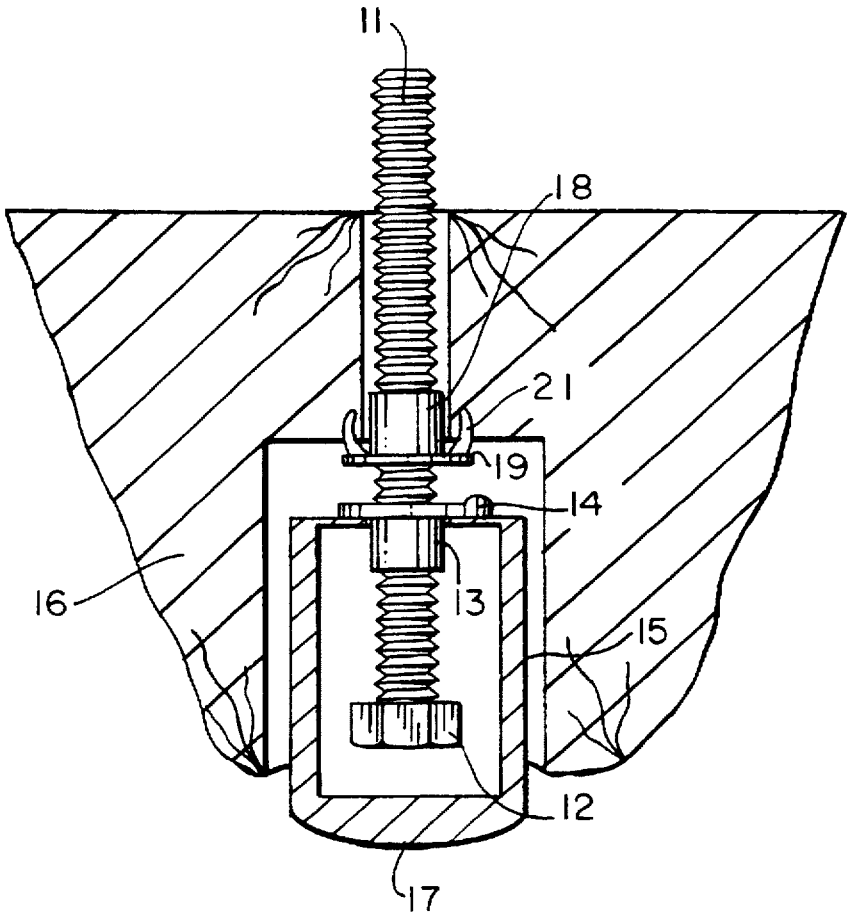
FIG. 3 is a cross-sectional view of a second embodiment of the invention.

FIG. 3 shows a second form of the invention constituted by an adjustable furniture leg consisting of a central bolt 11 having at its lower end a head 12. In threaded engagement with the bolt 11 is a boss 13 having a flange 14 to which the upper end of a tubular leg portion 15 is attached by welding. The lower end of the tubular leg portion 15 is closed by means a removable tube closer 17.

The cover in this embodiment consists of a solid block of turned wood 16. This is secured to the bolt 11 by means of the collar 18 having a flange 19 from which tangs 21 project. These tangs are driven into the wood constituting the cover 16, securing it firmly to the flange 19 and thus to the bolt at any predetermined position along the upper length of the upper part of the bolt. The extent to which the tube closer 17 projects from the cover may be readily adjusted by screwing the leg into or out of the cover. The head 12 of the bolt 11 prevents the leg from being completely removed from the bolt.

In both constructions described above the upper end of the bolt 1 or 11 projects beyond the cover and is intended to be screwed into a suitable threaded nut or other receptacle in the article of furniture to which the leg is attached.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. An adjustable furniture leg, comprising a central bolt for attaching the leg to an article of furniture and having a head projecting downwardly; a tubular leg portion surrounding and projecting below said head of said bolt, said tubular leg portion having an upper end and a lower end; means threaded on said bolt, said upper end of said tubular leg portion being secured to said means; a removable tubular closer, said lower end of said tubular leg portion being closed by said removable tubular closer; a cover surrounding said bolt and a portion of said tubular leg; means securing said cover to said bolt at a predetermined position relative to said head of said bolt, said securing means including a pair of nuts threaded onto said bolt to clamp between said nuts a portion of said cover member through which said bolt passes, whereby a position of said bolt at which said cover member is clamped can be adjusted, said bolt extending beyond an upper end of said cover for screwing into a threaded receptacle of an article of furniture to which the leg is attachable.

2. An adjustable furniture leg, comprising a central bolt for attaching the leg to an article of furniture and having a head projecting downwardly; a tubular leg portion surrounding and projecting below said head of said bolt, said tubular leg portion having an upper end and a lower end; threaded means onto said bolt, said upper end of said tubular leg portion being secured to said threaded means; a removable tubular closer, said lower end of said tubular leg portion being closed by said removable tubular closer; a cover surrounding said bolt and a portion of said tubular leg, said cover including a block of timber secured to said bolt; a collar screwed onto said bolt for securing said block of timber to said bolt, said collar having projecting tangs driven into a material of said cover, said tubular leg portion and said cover being formed so that an effective length of the adjustable furniture leg is adjustable by screwing said tubular leg portion in or out of said cover with said head of said bolt acting to prevent removal in a first direction of said tubular leg portion by screwing out by limiting a movement along said bolt of said means threaded onto said bolt, said bolt extending beyond an upper end of said cover for screwing into a threaded receptacle of an article of furniture to which the leg is attachable.

* * * * *